US007520472B2

(12) United States Patent
Peltz et al.

(10) Patent No.: US 7,520,472 B2
(45) Date of Patent: Apr. 21, 2009

(54) REMOTELY CONTROLLED LOCOMOTIVE CAR-KICKING CONTROL

(75) Inventors: David Michael Peltz, Melbourne, FL (US); Thomas Charles Leary, Papillion, NE (US); Mark Bradshaw Kraeling, Melbourne, FL (US); Brian Lee Staton, Palm Bay, FL (US); David Carroll Teeter, Satellite Beach, FL (US)

(73) Assignee: General Electric Company, Schenectady, NY (US)

( * ) Notice: Subject to any disclaimer, the term of this patent is extended or adjusted under 35 U.S.C. 154(b) by 332 days.

(21) Appl. No.: 11/113,562

(22) Filed: Apr. 25, 2005

(65) Prior Publication Data

US 2005/0253022 A1 Nov. 17, 2005

Related U.S. Application Data

(63) Continuation-in-part of application No. 10/366,436, filed on Feb. 13, 2003, now abandoned.

(60) Provisional application No. 60/365,572, filed on Mar. 19, 2002.

(51) Int. Cl.
*B61L 3/00* (2006.01)

(52) U.S. Cl. ..... 246/187 A; 246/187 B; 246/182 B; 701/20

(58) Field of Classification Search ..... 246/3, 246/4, 5, 182 R, 182 B, 182 C, 187 B, 187 A; 701/19, 20; 104/295, 296, 300; 105/26.5
See application file for complete search history.

(56) References Cited

U.S. PATENT DOCUMENTS

| | | | | |
|---|---|---|---|---|
| 5,511,749 | A * | 4/1996 | Horst et al. | 246/187 A |
| 5,685,507 | A | 11/1997 | Horst et al. | |
| 6,314,345 | B1 | 11/2001 | Coombes | |
| 6,353,780 | B1 | 3/2002 | Hart | |
| 6,449,536 | B1 | 9/2002 | Brousseau | |
| 6,470,245 | B1 | 10/2002 | Proulx | |
| 6,587,763 | B2 | 7/2003 | Ishikawa | |
| 6,658,331 | B2 | 12/2003 | Horst et al. | |

* cited by examiner

*Primary Examiner*—Mark T Le
(74) *Attorney, Agent, or Firm*—Robert Wawrzyn, Esq.; Robert L. Wolter, Esq.; Beusse Wolter Sanks Mora & Maire, P.A.

(57) ABSTRACT

A remote control system and method for the remote control operation of a locomotive in the performance of a car-kicking sequence comprises a portable control unit operable from a location off-board of the locomotive. The portable control unit includes an operator interface allowing an operator to initiate, with a single step, a predetermined sequence of locomotive operations for automatically performing a car-kicking procedure and generating a signal responsive to the single step for transmission to the locomotive. The system also includes a memory for storing a set of instructions corresponding to the predetermined sequence. An onboard slave control unit, interfaced with an operating system on the locomotive, receives the signal and automatically controls movement of the locomotive according to the set of instructions.

9 Claims, 4 Drawing Sheets

REMOTELY CONTROLLED LOCOMOTIVE CAR-KICKING CONTROL

This application is a continuation-in-part of and claims the benefit of the Feb. 13, 2003 filing date of U.S. patent application Ser. No. 10/366,436 (now abandoned), which claims priority to U.S. Provisional Patent Application, Ser. No. 60/365,572, filed on Mar. 19, 2002.

FIELD OF THE INVENTION

This invention relates generally to the field of rail transportation, and more particularly, to the remote control of a railroad locomotive during a railcar-kicking operation.

BACKGROUND OF THE INVENTION

The operation of a railroad involves the coupling and uncoupling of individual railcars and/or groups of railcars to one or more locomotives to form predetermined trains for specific hauling routes. "Car-kicking" is a method of breaking apart an existing train at a predetermined location in the string of railcars. Car-kicking is used at industrial sites, or in railcar classification yards, where a conventional hump/automatic retarder classification system is not available. The kicking operation typically requires a very skilled locomotive operator, ground operator and switchman to work in close coordination to safely and properly separate the train using this method.

The locomotive accelerates the railcars to be kicked to a desired speed and toward aligned switches. When the cars are moving, or when the desired speed is achieved, a man on the ground pulls the coupling pin from between adjacent railcars where the train will be broken. The locomotive engineer knows through experience when to decelerate the locomotive and quickly throttles down the locomotive and applies hard braking. The ensuing rapid deceleration of the locomotive sends a run-out wave down the train, causing the cars still coupled to the locomotive to decelerate, while the uncoupled cars continue to roll toward the desired track through the aligned switches.

Both the ground operator and locomotive engineer know which cars are to "kick" off of the train. The locomotive engineer may consider a number of parameters such as the number of cars to be "kicked", the weight of each car and the distance the cars are to be kicked from the locomotive, in order to time the deceleration of the locomotive so the uncoupled cars have sufficient momentum to roll through the repositioned switches and for a sufficient distance onto the side rail. Once the run-out wave has been sent, the locomotive operator must quickly decrease, or release, the brakes to prevent sliding of the locomotive wheels that could cause wheel damage. If several railcars or groups of cars are to be sent to other tracks in the classification yard, or industrial sidings, the ground man will call for another "shove" from the locomotive while the switchman repositions track switches to align the next set of uncoupled cars to roll onto another track.

It is known to remotely control a locomotive using a handheld operator control unit (OCU) that that is in radio communication with associated remotely controlled equipment onboard the locomotive. Such units are often used for switching operations. Canac, Inc. of Montreal, Canada, sells one such locomotive radio control system under the trademark Beltpack. Despite the capabilities of remote operation of a locomotive, car-kicking operations often still require different operators to pull coupling pins and control the movement of the locomotive, due in part because current locomotive remote control systems do not facilitate the rapid and complex actions that a single operator would have to perform. There are too many controls on an operator remote control unit that require manipulation by both hands of the remote control operator to allow that same person to assume the function of pulling the coupling pin and controlling the locomotive in a safe and effective manner.

BRIEF SUMMARY OF THE INVENTION

A locomotive remote control system interfaced with a locomotive onboard operating system is described herein enables a ground operator to effectively perform both the functions of controlling the movement of a locomotive performing a car-kicking sequence and pulling a coupling pin from between adjacent railcars. The remote control system described herein may comprise a portable control unit having an operator interface for inputting commands associated with movement of the locomotive, wherein the operator interface comprises an input mechanism mounted on the portable control unit for inputting at least one command associated with a predetermined car-kicking sequence for the locomotive. The portable control unit generates a command signal responsive to the input command and indicative of the car-kicking sequence for the locomotive. The remote control system also comprises an on-board control unit, interfaced with the locomotive onboard operating system, for receiving the signal. A processor is placed in communication with the slave control unit and the locomotive operating system and accesses a set of stored instructions for performing the car-kicking sequence responsive to the signal and for controlling the movement in accordance with the car-kicking sequence. The input mechanism is located on the operator control unit so an operator may manipulate the input mechanism with one hand and frees the operator's other hand for pulling a railcar-coupling pin.

A method of performing a remote controlled car-kicking operation with a locomotive and railcars is described herein as comprising the steps of providing a remote control operator unit to control movement of the locomotive responsive to a command input into the control unit; storing a set of instructions associated with a predetermined car-kicking sequence for the operation of the locomotive; generating a signal responsive to the command input and indicative of the predetermined car-kicking sequence; and, processing the signal to perform at least one instruction in accordance with the predetermined car-kicking sequence. As the locomotive performs the car-kicking sequence in accordance with the set of stored instructions, the ground operator is free to effectively perform the function of pulling the coupling pin, because the ground operator is not occupied with the manipulation of various input mechanisms to control movement of the locomotive. Performing the car-kicking sequence in accordance with the set of stored instructions in this manner is also advantageous when a second person is used for pin pulling but the locomotive operator is a novice. The locomotive operator does not require years of experience to perform highly effective car-kicking, because the car-kicking sequence is optimized.

DETAILED DESCRIPTION OF THE INVENTION

Figure 1:
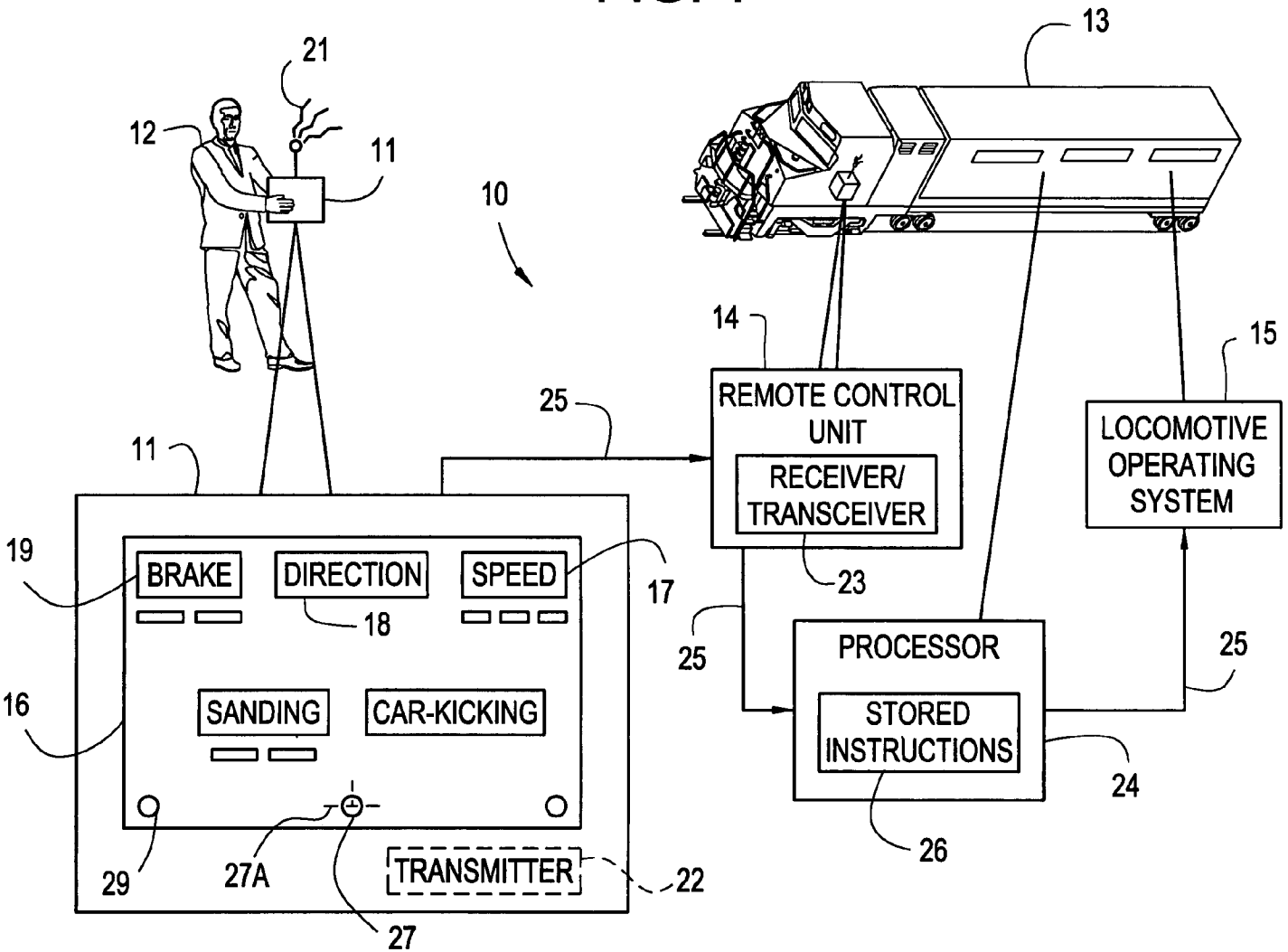
FIG. 1 is a schematic illustration of a locomotive remote control system.

With respect to FIG. 1, a locomotive remote control system 10 is schematically illustrated with a ground operator 12, for the remote control operation of a locomotive 13 to complete a car-kicking sequence. The term car-kicking sequence, as used herein, includes any one or more operations performed by the locomotive such as acceleration and deceleration, and the corresponding functions such as braking, sanding, speed, as necessary to complete a car-kicking sequence. The remote control system 10 shown in FIG. 1 includes a portable operator controlled unit (OCU) 11 that is hand-held by an operator 12 on the ground, and a slave control unit 14 on the locomotive 13, which is interfaced with a locomotive onboard operating system 15. The operating control unit 11 includes an operator interface 16 that comprises a plurality of input mechanisms such as switches, keyboard, touch-sensitive screens, buttons, levers, dials or voice-activated devices for inputting commands for the operation of the locomotive. The term input mechanism or switch as used herein includes any one of such input mechanisms or any other such mechanism that one skilled in the art would appreciate may be used with such a remote control system 10.

Input may include, but is not limited to, commands controlling the speed, direction, braking, sanding and/or direction for the operation of the locomotive. For example the interface 16 includes input command mechanisms for speed 17, direction 18, brakes 19 and a car-kicking switch 20. The interface 16 may include other input commands for horns, safety lights and/or headlights that are not shown in FIG. 1.

The operating control unit 11 is equipped with a transmitter 22 for transmission of a signal 21 in response to, and indicative of, an input command. The transmitter 22 may send a radio frequency transmission to the slave control unit 14, which incorporates a receiver 23 for detecting and receiving the command signal 21, which is then interpreted by processor 24. The processor 24, or processing means, is interfaced with the slave control unit 14 and the locomotive on-board operating system 15 for the operation of the locomotive 13. The processor 24 interprets the signal 21 and generates a digital output representative of the input command that controls movement of the locomotive through the onboard operating system 15.

In an exemplary embodiment of the present invention, the interface 16 includes a switch 20 for allowing an operator to initiate, with a single step, a predetermined sequence of locomotive operations for automatically performing a car-kicking procedure of the locomotive 13. For example, the operator may issue a car-kicking command with a single step, such as by actuating the switch 20, to initiate the predetermined sequence for car-kicking. The transmitter 22 generates a signal 25 indicative of the car-kicking input command. The car-kicking sequence is predetermined in the sense that parameter data with respect to the car-kicking sequence may be stored in the slave control unit 14, processor 24 and/or locomotive operating system 15. The parameter data may correspond to such car-kicking function such as a target locomotive speed, a maximum and/or minimum time period for maintaining the target speed, brake pressure, a maximum and/or minimum time period for applying brake pressure, weight of the cars to be cut, grade of the tracks, etc. The parameter data related to car-kicking sequence may be manually input, or up-loaded on a periodic or real-time basis through a radio link to the slave control unit 14.

The processor 24 translates/interprets the signal 25, and generates an output including at least a portion of a set of stored instructions 26 in accordance with the predetermined car-kicking sequence. The stored instructions 26 may include an algorithm associated with an acceleration sequence and/or deceleration sequence necessary to perform a car-kicking sequence. The onboard operating system or the operator control unit are equipped with a memory for storing the instructions. For example, the algorithm may include instructions to accelerate the locomotive 13 in reverse to a target speed of 6 miles per hour and/or apply brakes at a pressure of 70 psi until the locomotive reaches 3 miles per hour, after which the brakes would be "feathered-off" to 20 psi until the locomotive comes to a stop.

Figure 5:
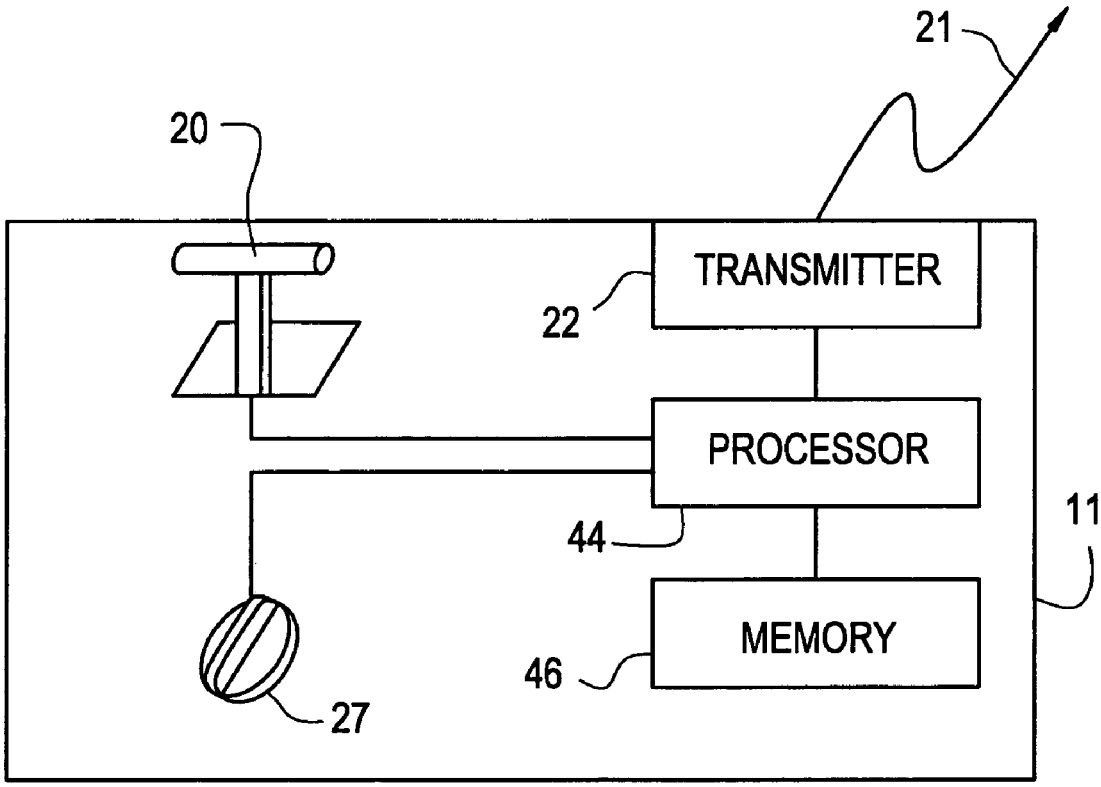
FIG. 5 is a schematic illustration of an exemplary embodiment of an operator control unit.

Alternatively, as shown in FIG. 5, the portable operator control unit 11 may include a processor 44 in communication with a memory 46 for storing the set of instructions 26. Based on a command initiated, for example, via switch 20 and/or a position of a mode indicator 27, the signal 25 is generated by the operator control unit 11 that includes one or more of the stored instructions. Accordingly, the onboard operating system may not need to perform the step of interpreting the signal 25, and automatically performs a requested car kicking procedure according the instructions stored in memory 46 that have been included in the signal 25.

Figure 2:
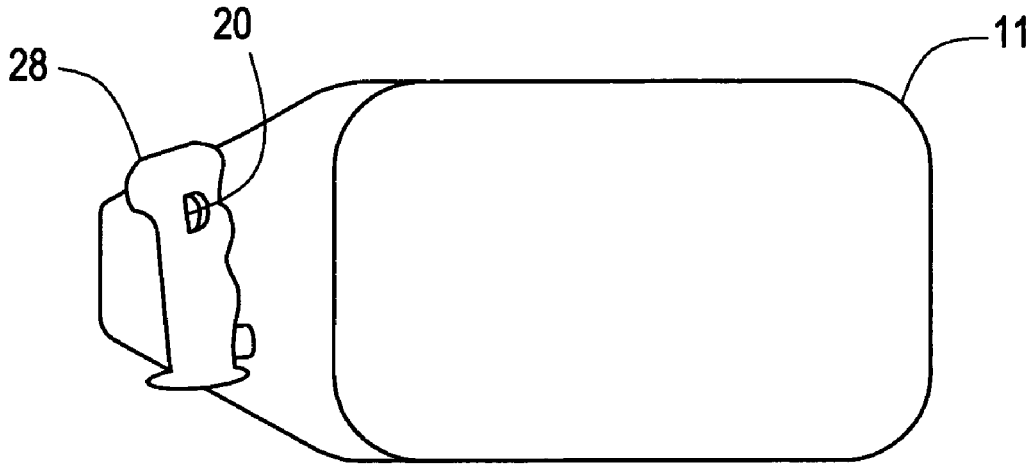
FIG. 2 is a rear perspective view of an operator control unit, with a trigger input mechanism.

The switch 20 may be actuated to one or more positions for inputting a car-kicking command associated with each position. In an exemplary embodiment shown in FIG. 2, the switch 20 is positioned on the operator control unit 11 so the operator may control movement of the locomotive 13 during a car-kicking sequence using one hand, and pull a coupling pin (not shown) to separate railcars. The operator control unit 11, shown in FIG. 2, is a typical portable unit that may be strapped to the waist of an operator. The switch 20 takes the form of a trigger-switch mounted a grip input mechanism 28, which may be actuated to control the speed of the locomotive 13. In addition, a mode indicator 27, for identifying different modes of operation of the locomotive 13 is mounted on the operator control unit 11, and includes a car-kicking mode 27A. The operator control unit 11 also includes the typical command input mechanisms to control the functions of the locomotive 13, such as speed, direction, braking, lights, horns, sanding etc.

When an operator 12 sets the mode indicator 27 to a car-kicking mode 27A, the switch 20 is "hot" or active. The operator 12 actuates the switch 20, and the operator control unit 11 generates a signal that is transmitted to the slave control unit 14 and processor 24, that a car-kicking sequence command is impending. The operator control unit 11 preferably includes an audio or visual indicator to notify the operator that the switch 20 is armed. The receiver 23 of the slave control unit 14 may be a transceiver for transmission of a responsive actuation of the switch 20 to display the activation of the switch 20 by indicator 28.

The typical input commands are used to accelerate the locomotive 13 in a desired direction, and to a target speed. When the locomotive 13 is at or near the desired speed, the operator 12 pulls the coupling pin. Immediately before or after, or while the operator 12 pulls the coupling pin, the operator 12 releases the switch 20 and the operator control unit 11 generates the signal 25 indicative of the predetermined car-kicking sequence. In the exemplary embodiment, the car-kicking sequence includes a sequence of functions performed by the onboard operating system 15 to decelerate the locomotive 13 to a predetermined target speed or to a stop.

Preferably, when the switch 20 is actuated to input the command, the car-kicking sequence overrides any manual control of the movement of the locomotive 13. After the locomotive 13 stops or decelerates to the target speed, the switch 20 is automatically deactivated, or manually deactivated when the operator adjusts the mode indicator 27 from the car-kicking mode 27A.

As noted above, the instructions may preferably be stored within a memory component of the processor 24, which is interfaced with the onboard operating system 15. An operator 12 may adapt the instructions 26 in accordance with varying weather conditions or features of a particular switching yard. In addition, the operator 12 may adapt the instructions 26 according to the operation of a particular locomotive 13 in a particular switching yard and/or under particular whether conditions. In order to minimize the activity of the ground operator 12, the operator control unit 11 and operator interface 16 may include an instruction display mode and input mechanism to display a list of instructions 26 for each of a variety of conditions, and input a selected instruction.

Figure 3:
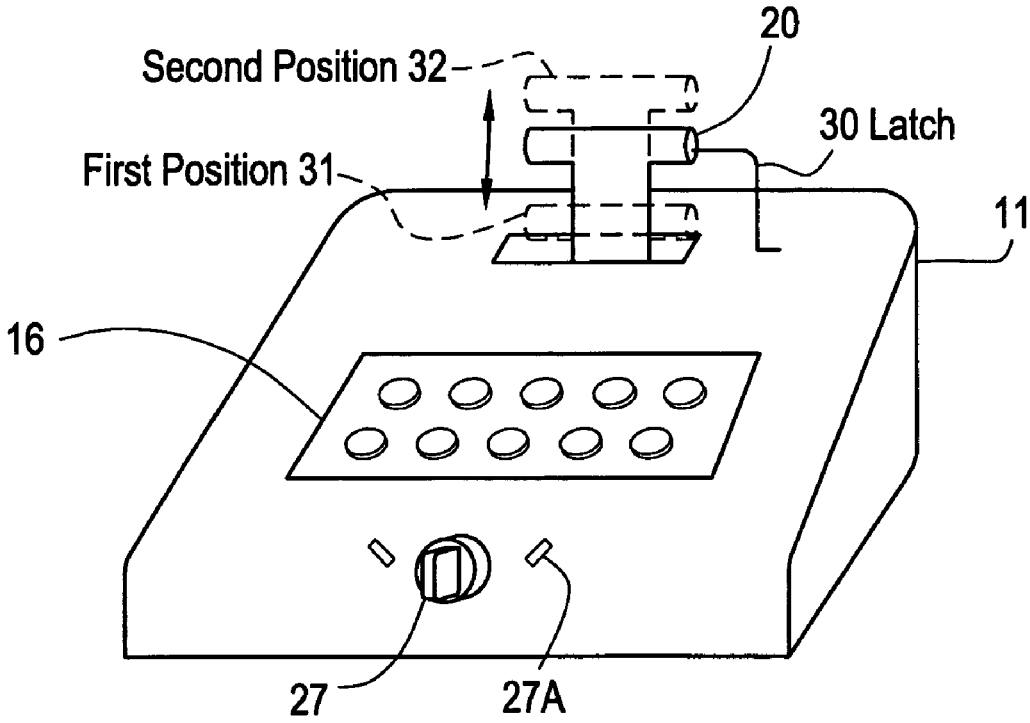
FIG. 3 is a front perspective view of an operator control unit with a lever input mechanism.

A second exemplary embodiment automates the acceleration and deceleration of the locomotive target speed to perform a predetermined car-kicking sequence. Accordingly, the stored instructions 26 control a sequence of locomotive 13 operations to accelerate the locomotive 13 to a target speed prior to decelerating the locomotive 13, by braking (including brake-reduction) and sanding. The switch 20 is actuable between two positions including a first position associated with an acceleration operating sequence of the locomotive, and a second position associated with a deceleration operating sequence of the locomotive. As shown in FIG. 3, the switch 20, takes the form of a spring-loaded lever that is actuated in an up/down, side-to-side or forward/reverse direction. A latch 30 is preferably mounted on the operator control unit 11, to prevent the inadvertent actuation of the switch 20. In addition, the spring-loaded characteristic allows the automatic release of the switch 20 to a second position 32, after the operator releases the switch from its depressed first position 31.

Figure 4:
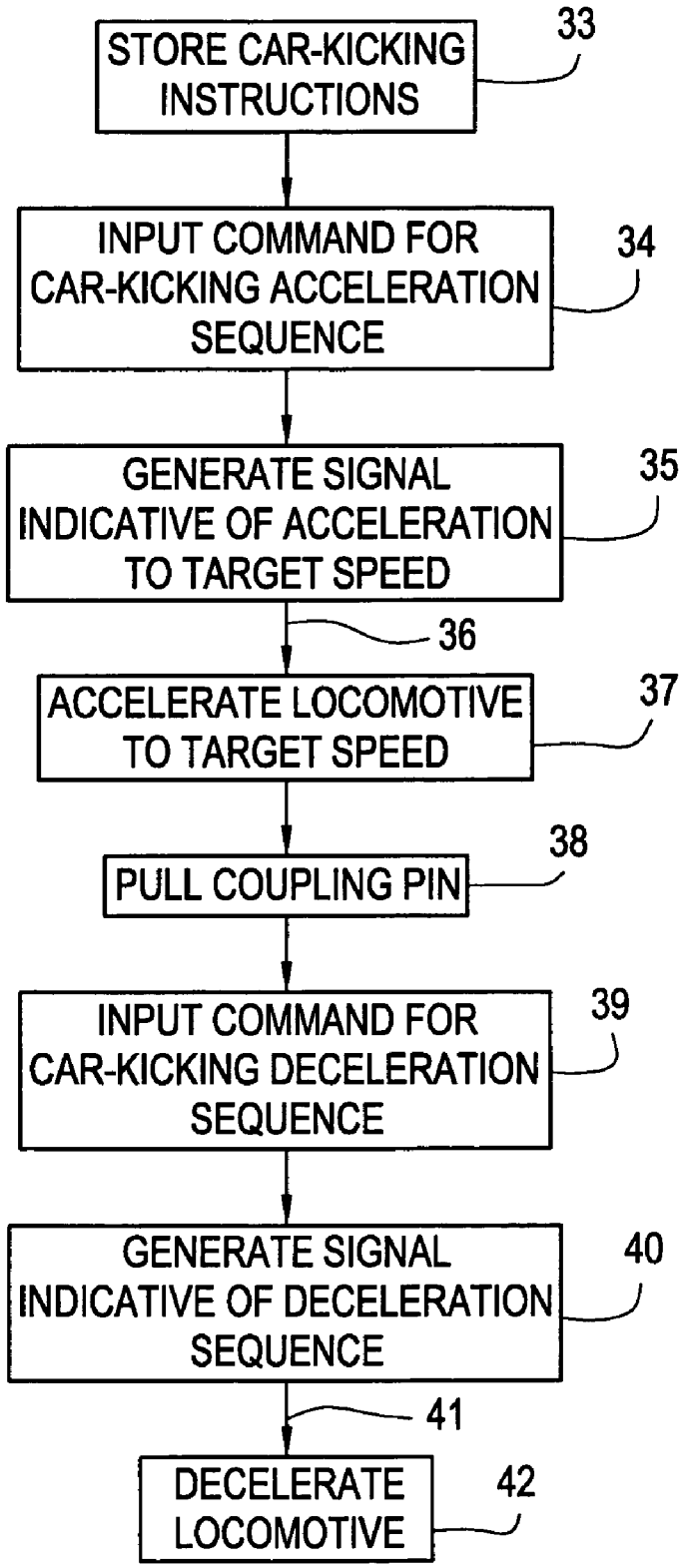
FIG. 4 is a flow chart for the remote control operation of a car-kicking sequence operation of a locomotive.

The remote control operation of the locomotive 13 may follow the steps as described herein and shown in FIG. 4. Prior to initiating a car-kicking sequence, the operator 12 may input data necessary for performance of the set of instructions 26 for the operation of the locomotive 13. For example, an operator 12 may input a maximum speed and a maximum continuous braking application. As described above, the interface 16 of the operator control unit 11 may include a mode indicator 27 that enables the operator control unit 11 to initiate the car-kicking sequence; however, the mode indicator 27 is not required for the operation of the present invention. When the mode is set for car-kicking 27A, the enable buttons 17-19 are deactivated, and the locomotive 13 brakes remain applied until the following command to initiate the car-kicking sequence.

As set forth in steps 34 and 35, when the operator 12 is ready to initiate the car-kicking sequence, the switch 20 is unlatched and actuated to a first position 31 to input a command, and the operator control unit 11 generates a first signal 36 indicative of a predetermined acceleration sequence command. The predetermined acceleration sequence may comprise the algorithm or set of instructions 26 associated with acceleration of the locomotive to a target speed within a determined time period. When the switch 20 is actuated to a first position 31, the first signal 36 is received by the slave control unit 14 and transmitted to the processor 24, which analyzes the signal and produces the digital output indicative of the acceleration sequence. For example, the locomotive 13 and locomotive operating system 15 may respond to the signal output and instructions 26 by: 1) releasing the brakes; 2) throttle up to setting II for a predetermined time period to reach a target speed of 6 mph; and, 3) throttle back to maintain a predetermined target speed. Typically, the target speed is never reached, but with this procedure avoids exceeding the target speed.

The input mechanisms, including the brake 19, speed 17, direction 18, etc. are enabled, or activated, when the car-kicking switch 20 is activated, or when the mode indicator 27 is set for the car-kicking mode 27A, as described above. By enabling the input mechanisms, the operator may override the predetermined car-kicking sequence if necessary.

When the locomotive 13 has reached the target speed, the operator 12 can pull the coupling pin to ready the locomotive 13 for a kick as set forth in step 39. The operator 12 will release, or actuate, the switch 20 to a second position 32 to input a second command associated with the car-kicking sequence. The operator control unit 11 generates a second signal 41 that is indicative of a sequence of functions for decelerating the locomotive 13. The sequence of functions are effected when the slave control unit 14 receives the second signal 41, and the processor 24 interprets the signal 41, and generates a digital output indicative of the set of stored instructions 26 for the deceleration of the locomotive, as set forth in step 42. For example the instructions may include the following commands: 1) adjust the throttle to an idle position; 2) apply brakes at predetermined rate (e.g., 70 psi) for a predetermined time (e.g., 30 seconds); and, 4) after the predetermined time for application of the brakes has elapsed, reduce the brake cylinder pressure to 20 psi.

The car-kicking sequence is completed, with the railcars having been kicked from the train. If the operator 12 desires to initiate another car-kicking sequence, the locomotive is repositioned using the necessary input mechanisms and the switch 20 is unlatched for actuation and initiation of another car-kicking sequence. In this described manner, the remote control operator unit 11 is capable of generating signals for the remote control operation of the locomotive 13 car-kicking sequence. Accordingly, the ground operator 12 is able to operate the locomotive 13 without the assistance of a locomotive engineer or a second ground operator.

The present invention is not limited by the specific commands, instructions, sequence of functions and/or parameters as described above to affect a car-kicking sequence. The foregoing may vary according to changes in weather conditions, different switching yards and/or different locomotives. The embodiments described above have been provided by way of example to describe the use of a remote control system 10 and operator control unit 11 capable of generating a signal indicative of a car-kicking signal, and the elements necessary to receive and process the signal for the locomotive to complete the car-kicking sequence.

Based on the foregoing specification, the methods described may be implemented using computer programming or engineering techniques including computer software, firmware, hardware or any combination or subset thereof, wherein the technical effect is to provide remotely controlled car kicking control. Any such resulting program, having computer-readable code means, may be embodied or provided within one or more computer-readable media, thereby making a computer program product, i.e., an article of manufacture, according to the invention. For example, computer readable media containing program instructions for automatically performing a remote control car-kicking operation as described in the foregoing specification may include a computer program code for receiving, at a portable control unit off-board the locomotive, a single command to initiate a predetermined sequence of locomotive operations for automatically performing a car-kicking procedure and generating a signal at the portable control unit responsive to the single command for transmission to a slave control unit onboard the locomotive. The computer readable media may also include a computer program code for receiving the signal at the slave control unit onboard the locomotive and automatically controlling, responsive to the signal, movement of the locomotive according to a set of instructions stored in memory corresponding to the predetermined sequence of locomotive operations for automatically performing the car-kicking procedure. The computer readable media may be, for example, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will be able to combine the software created as described with appropriate general purpose or special purpose computer hardware, such as a microprocessor, to create a computer system or computer sub-system embodying the method of the invention. An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

We claim:

1. A remote control system for controlling the movement of a train including a locomotive linked with a plurality railcars and the locomotive having an onboard operating system to execute a car-kicking operation to separate a railcar from the train while moving on a track, the remote control system comprising:

a portable control unit operable from a location off-board of the locomotive comprising an operator interface having a single input mechanism allowing an operator to initiate a sequence of locomotive operations for automatically performing and completing a car-kicking procedure by generating a signal responsive to actuation of the input mechanism for transmission of the signal to the locomotive;

a memory for storing data relative to train, locomotive and track operating parameters and one or more sets of instructions each for completing a respective car-kicking operation associated with differing operating parameter data;

a processor, in response to the signal generated by the portable control unit, is configured to select and generate one of said one or more sets of instructions to complete a car-kicking procedure that includes an acceleration and deceleration sequence of locomotive operations wherein the set of instructions is selected based on the train, locomotive and track operating parameter data; and, an onboard slave control unit, interfaced with an operating system on the locomotive and the processor, for automatically controlling movement of the locomotive according to the set of instructions.

2. The remote control system of claim 1, wherein the operator interface includes an operations mode indicator for selecting different modes of operation of the locomotive including a mode in which the portable control unit generates the signal responsive to the command.

3. The remote control system of claim 1, wherein the input mechanism is operable by one hand of an operator.

4. The remote control system of claim 1, wherein the memory is located off-board of the locomotive.

5. The remote control system of claim 1, wherein the memory is located onboard the locomotive.

6. A method for automatically performing a remote control car-kicking operation with a locomotive and railcars on a track by a single operator, the locomotive having a slave control unit in communication with a portable control unit off-board the locomotive, the method comprising:

storing in a memory train, locomotive and track operating parameter data relative to performing a car-kicking operation and one or more sets of instructions for completing a car-kicking operation associated with differing operating parameter data;

inputting current train, locomotive and track operating parameter data;

generating, at a portable control unit off-board a locomotive, a single command to initiate a sequence of locomotive operations for automatically performing and completing a car-kicking procedure;

in response to the signal being generated from the portable control unit, selecting one of the one or more sets of instructions to complete a car-kicking operation by associating the current operating parameter data with the stored operating parameter data; and, automatically controlling, responsive to the signal, an acceleration sequence and a deceleration sequence of the locomotive according to selected one or more sets of instructions for automatically initiating and completing the car-kicking procedure.

7. The method of claim 6, comprising:

accelerating the locomotive to a predetermined target speed responsive to receiving a first command to initiate a predetermined sequence of locomotive operations for automatically performing a first portion of car-kicking procedure; and removing a coupling pin from between adjacent railcars after the locomotive has reached the target speed.

8. Computer readable media containing program instructions for automatically performing a remote control car-kicking operation with a locomotive and railcars on a track, the locomotive having a slave control unit in communication with a portable control unit off-board the locomotive, the computer readable media comprising:

a computer program code for generating, at a portable control unit off-board a locomotive, a single command to initiate a sequence of locomotive operations for automatically performing and completing a car-kicking procedure;

a computer program for storing one or more sets of instructions for completing a car-kicking operation, the set of instructions including sequences for accelerating and decelerating operations, and for storing locomotive, train and track operating parameter data wherein the acceleration and deceleration sequences are associated with the differing operating parameter data;

a computer program for selecting one of the one or more sets of instructions including an acceleration and deceleration sequence by comparing current train, locomotive and track operating parameters with the stored operating parameter data; and a computer program code, responsive to the command from the portable unit, for generating a command for the selected acceleration and deceleration sequence based on the stored and current operating parameter data.

9. A method for performing a remote control car-kicking operation with a locomotive and railcars in a train on a track, the method comprising the steps of:

(a) using an operator control unit operable to remotely control the movement of the locomotive responsive to commands input into the operator control unit by the operator;

(b) storing one or more sets of instructions corresponding to sequences of locomotive acceleration and deceleration operations, for automatically performing and completing a car-kicking procedure, within a memory in communication with the locomotive onboard operating system and for controlling movement of the locomotive and the sequence of operations is associated with stored train, locomotive and track operating parameter data;

(c) providing a processor in communication with the operator control unit, the locomotive onboard operating system, and the stored set of instructions;

(d) receiving, at the operator control unit, a single command from an operator to initiate the sequence of locomotive operations for automatically performing and completing the car-kicking procedure;

(e) selecting from the one or more sets of instructions a sequence of acceleration and deceleration operations by current operating parameters of the locomotive, train and track to the stored operating parameter data;

(f) generating a command via the onboard operating system for the locomotive to perform the selected acceleration sequence including accelerating the locomotive to a predetermined target speed to initiate a first portion of the sequence of locomotive operations for automatically performing the car-kicking procedure and then the operator pulling a coupling pin from between adjacent railcars after the locomotive has reached the target speed of locomotive operations for automatically performing the car-kicking procedure; and, (g) generating a command via the onboard operating system for the locomotive to perform the selected deceleration sequence including decelerating the speed of the locomotive to initiate a second portion of the predetermined sequence of locomotive operations for automatically performing the car-kicking procedure after the operator has pulled the coupling pin.

* * * * *